United States Patent [19]

Cicin-Sain

[11] 4,207,820

[45] Jun. 17, 1980

[54] MOBILE APPARATUS FOR THE RENEWAL AND FOR THE CONSTRUCTION OF RAILWAY TRACKS

[75] Inventor: Ivo Cicin-Sain, Bussigny-pres-Lausanne, Switzerland

[73] Assignee: Matisa Materiel Industriel S.A., Lausanne, Switzerland

[21] Appl. No.: 896,016

[22] Filed: Apr. 12, 1978

[30] Foreign Application Priority Data

Apr. 22, 1977 [CH] Switzerland ..... 4998/77

[51] Int. Cl.[2] ..... E01B 29/05

[52] U.S. Cl. ..... 104/2; 104/6; 105/4 R

[58] Field of Search ..... 104/1 R, 2, 4, 5, 6, 104/7 R, 7 B, 16, 17 R, 3; 105/4 R

[56] References Cited

U.S. PATENT DOCUMENTS

| | | | |
|---|---|---|---|
| 3,494,297 | 2/1970 | Plasser et al. | 104/7 B |
| 3,699,894 | 10/1972 | Plasser et al. | 104/2 |
| 4,000,699 | 1/1977 | Scheuchzer | 104/6 X |
| 4,046,077 | 9/1977 | Theurer et al. | 104/2 |
| 4,160,418 | 7/1979 | Theurer | 104/2 |

FOREIGN PATENT DOCUMENTS

| | | | |
|---|---|---|---|
| 552160 | 6/1932 | Fed. Rep. of Germany | 104/7 R |
| 2129180 | 1/1972 | Fed. Rep. of Germany | 104/2 |
| 2614437 | 10/1977 | Fed. Rep. of Germany | 104/106 |
| 1963679 | 2/1979 | Fed. Rep. of Germany | 105/4 R |
| 2298645 | 8/1976 | France | 104/2 |

*Primary Examiner*—Randolph A. Reese

*Attorney, Agent, or Firm*—Wenderoth, Lind & Ponack

[57] ABSTRACT

There is described a mobile apparatus for laying of railway tracks. The apparatus includes a working tool carrying chassis capable of laying of new ties, a wagon for transporting and handling of material necessary for the track laying and a carrying bridge structure having one end carried by a rolling support and the other end comprising a rolling support and at least one supplementary retractable rolling support which is adapted to bear on the track bed. The carrying chassis is suspended above a working zone from the carrying bridge structure. The device is characterized in that the carrying bridge structure includes a wagon having only a single rolling support disposed at its end and provided with the aforementioned retractable supplementary rolling support and a longitudinally extending raised chassis which is pivoted at its other end to an overhanging bracket extending from the wagon which transports and handles the material. The device is further characterized in that the carrying chassis is suspended and articulated at one end to the overhanging bracket and at the other end to the raised chassis of the wagon which has a single rolling support; and still further in that this carrying chassis is mounted so as to be height adjustable, the single rolling support wagon having a supplementary height adjustable tie laying means on its raised chassis disposed near its rolling support.

13 Claims, 7 Drawing Figures

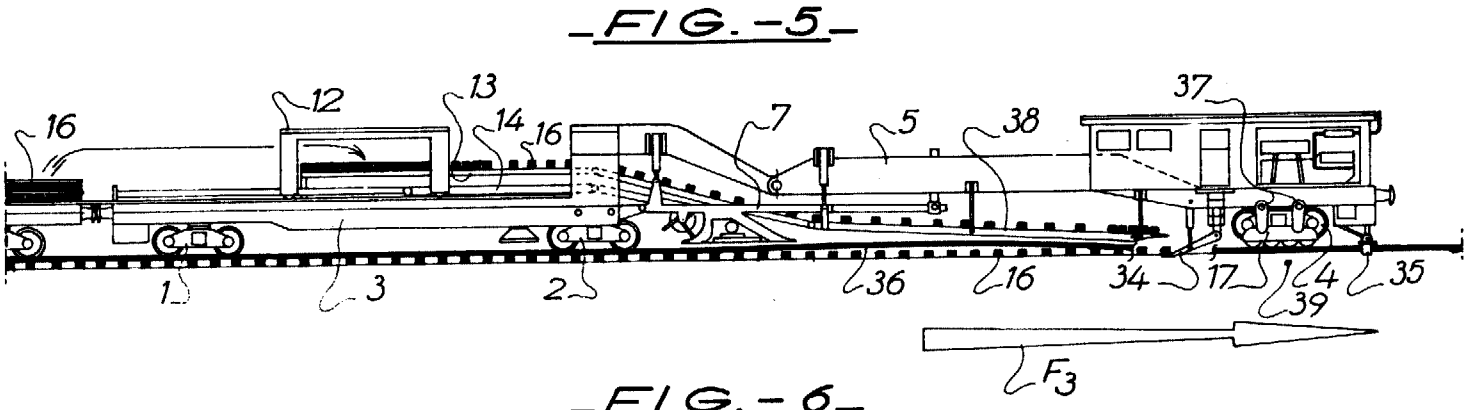
-FIG. -5-
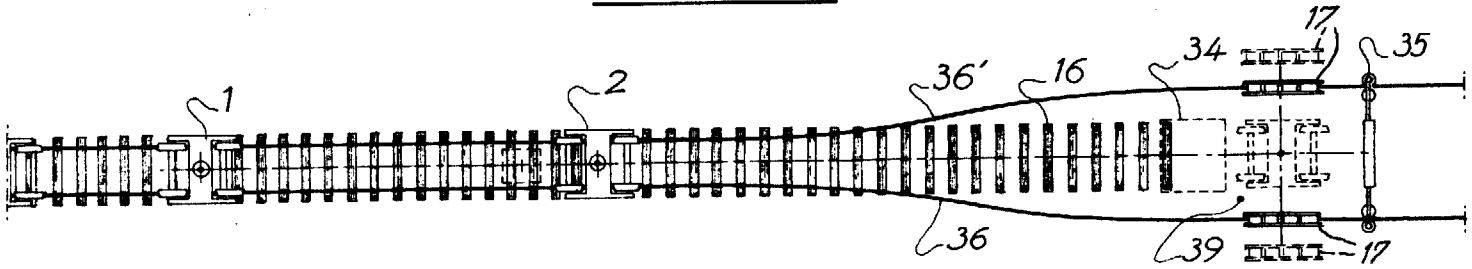
-FIG. -6-

MOBILE APPARATUS FOR THE RENEWAL AND FOR THE CONSTRUCTION OF RAILWAY TRACKS

BACKGROUND OF THE INVENTION

The present invention relates to a mobile apparatus for the renewal and for the construction of railway tracks by continuous advance comprising a chassis carrying a working tool for effecting at least the laying of new sleepers and/or the removal of the old sleepers, a wagon adapted for transporting, stocking and/or for the handling of the material necessary for the said laying and/or of material resulting from the said removal operation, and a carrying bridge structure having one end carried by a rolling support adapted to roll on an old track during the renewal thereof and on a new track during the construction thereof and the other end of the bridge structure in turn comprises a rolling support adapted to roll on the reconstructed track during a renewal operation and at least one supplementary retractable rolling support adapted to bear on the platform or bed adapted to support a new track to be constructed, the tool carrying chassis being suspended from the said carrying bridge structure above the work zone.

Apparatus is known in which the carrying bridge structure is a rigid wagon whose raised chassis connects to the two bogies. In this apparatus a tool carrying chassis permits in the case of a renewal operation of an old railway track, the removal of the old sleepers, the remaking of the ballast bed and the laying of new sleepers. A system of conveyors and distributors installed on the wagon and underneath the carrying bridge structure permits the transportation and the storing of the old removed ties and the distribution of the new ties to be laid while a rail guiding device ensures the spacing from the track of the old previously unspiked rails and the location of such therealong and the bringing near and laying of the new rails at normal spacing on the newly laid ties, where the new rails have been previously disposed on each side of the said track to be renewed. In the construction of a new track on a previously prepared bed, this same apparatus permits, after deactivating the tool necessary for the removal of the old ties and those necessary for the remaking of the ballast bed, and after the operating of the supplementary rolling support on the said bed, the laying on such of the new ties of the rails of the new track which have likewise been previously disposed on each side of the track to be constructed on the bed and the bringing together and laying at normal spacing on these ties.

This apparatus works satisfactorily not only for renewal operations but also for the construction of railway tracks although it necessitates an adjusting device for curved working for the transverse positioning of the work tool carrying chassis with respect to the longitudinal axis of the carrying bridge structure. In operation as the bridge structure bears by its two ends on the track, the tool carrying chassis necessarily situated between these two ends is offset in a curve towards the inside thereof and it is then necessary to displace the tool carrying chassis transversally in such a manner that at least the new tie laying tool is perpendicular to the longitudinal axis of the track.

Railway track renewal apparatus is disclosed in Swiss Pat. No. 511,332, in which provision of the previously mentioned adjusting device is avoided by a conformation of the carrying bridge structure in the form of a girder articulated at its two ends to two overhanging brackets of two wagons framing the said girder. In this apparatus, the geometric arrangement on the railway track of the supports and of the articulations of the two wagons framing the girder is automatically established in the curves in a tangetial manner, the projection of the longitudinal axis of the tool carrying chassis suspended to the said girder with the longitudinal axis of the railway track and the laying tool is placed at the tangent point of the two aforesaid axes.

This apparatus provides satisfactory operation for the renewal of railway tracks but it cannot be used for their construction due to the fact of the near impossibility of moving on the bed bereft of track the first of the two wagons framing the girder because this wagon is necessarily provided like the other with two bogies so as to ensure the equilibrium and the guiding of the girder articulated to its overhanding bracket. Moreover, an adaptation of such a structure to the construction of a railway track, if in fact such an adaptation could be made, would be impractical because of the prohibitive cost, maintenance costs and the energy necessary to be expended to exploit such an apparatus due to its size, fragility and weight.

An object of the invention is the provision of a device having a particular arrangement of its carrying bridge structure ensuring in a simple manner, the aforesaid tangent effect of the axis of the work tool carrying chassis with respect to the longitudinal axis of the railway track in curved regions which device is not only capable of the renewal but also the construction of railway tracks.

SUMMARY OF THE INVENTION

According to the present invention there is provided a mobile apparatus for the renewal and for the construction of railway tracks comprising a chassis carrying working tool and adapted to effect at least the laying of new ties and/or the removal of old ties, a wagon for transporting stocking and/or for the handling material necessary for the said laying and/or the material resulting from the removal operation, and a carrying bridge structure having one end carried by a rolling support and the other end comprising a rolling support and at least one supplementary retractable rolling support adapted to bear on the bed adapted to support a new track to be constructed, said carrying chassis being suspended above the working zone from said carrying bridge structure, characterized in that the carrying bridge structure comprises a wagon having only a single rolling support disposed at its end provided with a retractable supplementary rolling support and of which the raised chassis from the said rolling support is pivoted at its other end to an overhanding bracket extending from the wagon adapted for transport, stocking and/or the handling of material; and in that the carrying chassis is suspended and articulated at one end to the overhanding bracket and at the other end to raised chassis of the wagon having a single rolling support; and in that this carrying chassis is mounted so as to be adjustable in height; and in that the single rolling support wagon has a supplementary sleeper laying tool adjustable in height on the side of its raised chassis and disposed near its rolling support.

The articulation of the junction of the two wagons may be such as to provide a swivel effect ensuring the free longitudinal articulation of the wagons in all directions as well as their axial rotation, at least within the maximum limits of the curves and bends of the railway tracks.

BRIEF DESCRIPTION OF THE DRAWINGS

The following is a description by way of example of certain embodiment of the invention reference being had to the accompanying drawings, in which

FIG. 5 is a side view of the apparatus in a railway track construction mode; and FIG. 6 is a partial schematic plan view of the arrangement of FIG. 5.

DESCRIPTION OF THE PREFERED EMBODIMENTS

Figure 1:
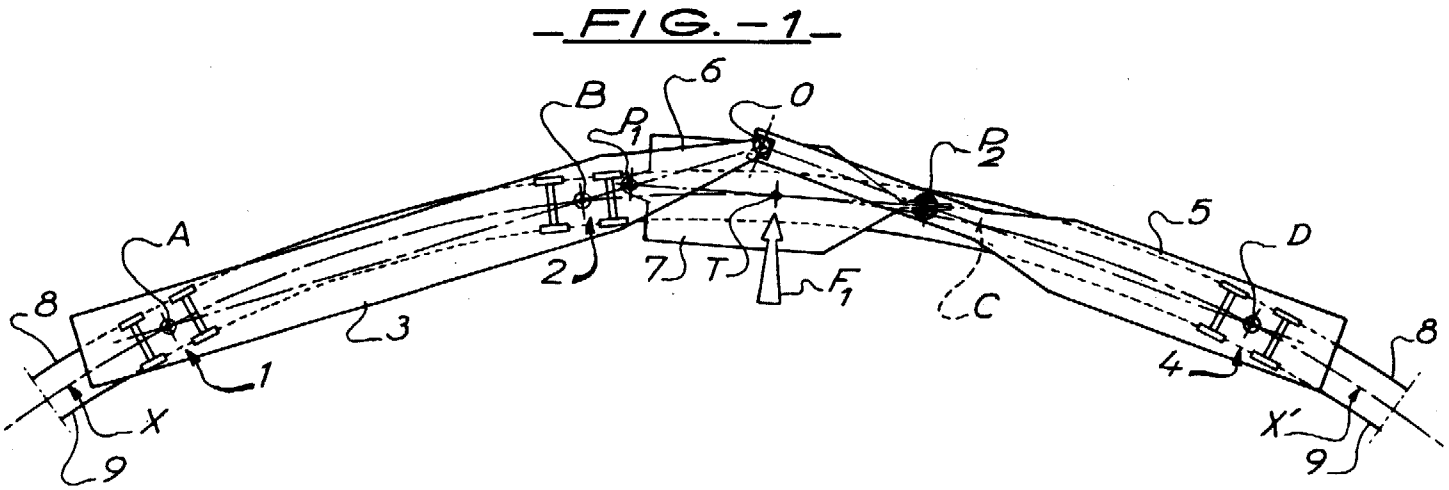
FIG. 1 is a schematic plan view of a mobile apparatus on a curved track section.

In FIG. 1 two points A and B represent the pivotal axes of bogies 1 and 2 of a twin bogie wagon 3 and point D represents the pivotal axis of a single bogie 4 of a wagon 5 whose chassis is pivoted to a point O carried by an overhanding bracket 6 of the wagon 3. Points $P_1$ and $P_2$ represent the pivotal axes of the two ends of chassis 7 for carrying working tools.

The points A, B and D lie on the longitudinal axis XX' of the track schematically represented by two rails 8 and 9, the points A, B, $P_1$ and O are aligned and form a first secant AO to the arc XX', and the points D, $P_2$ and O form a second secant DO to the said arc XX'.

The first secant AO cuts the arc XX', representing the axis of the railway track, at the points A and B substantially representing the pivotal axes of the bogies 1 and 2 of the wagon 3 and the second secant DO cuts this arc XX' at the point D substantially representing the pivotal axis of the single bogie 4 of the wagon 5 and at a second imaginary point C.

The straight segment $P_1 P_2$, substantially representing the distance between the two pivotal axes of the chassis 7, is tangential at a point T to the longitudinal axis XX' of the railway track.

All these points A, B, $P_1$, O, $P_2$, C, D and T are clearly represented here as projected on the plan of the track but are in reality more or less upwardly spaced therefrom.

The geometry of the schematically represented apparatus as drawn, permits, within the limits of the usual radii of curvature of railway tracks and taking account of the relative proportion of the length of the apparatus with respect to the said radii, the automatic insurance of the tangency at the point T of the longitudinal axis $P_1$ $P_2$ of the tool carrying chassis 7 with the longitudinal axis XX' of the railway track in the curves. This point T is indicated by the arrow $F_1$.

One of the two joints (point $P_2$) of the chassis 7, permits slight level axial displacement of the chassis 7 so as to compensate for the small variations of the spacing between these two joints which are produced by the changes of the radii of curvature of track travelled.

Figures 2, 3, 4:
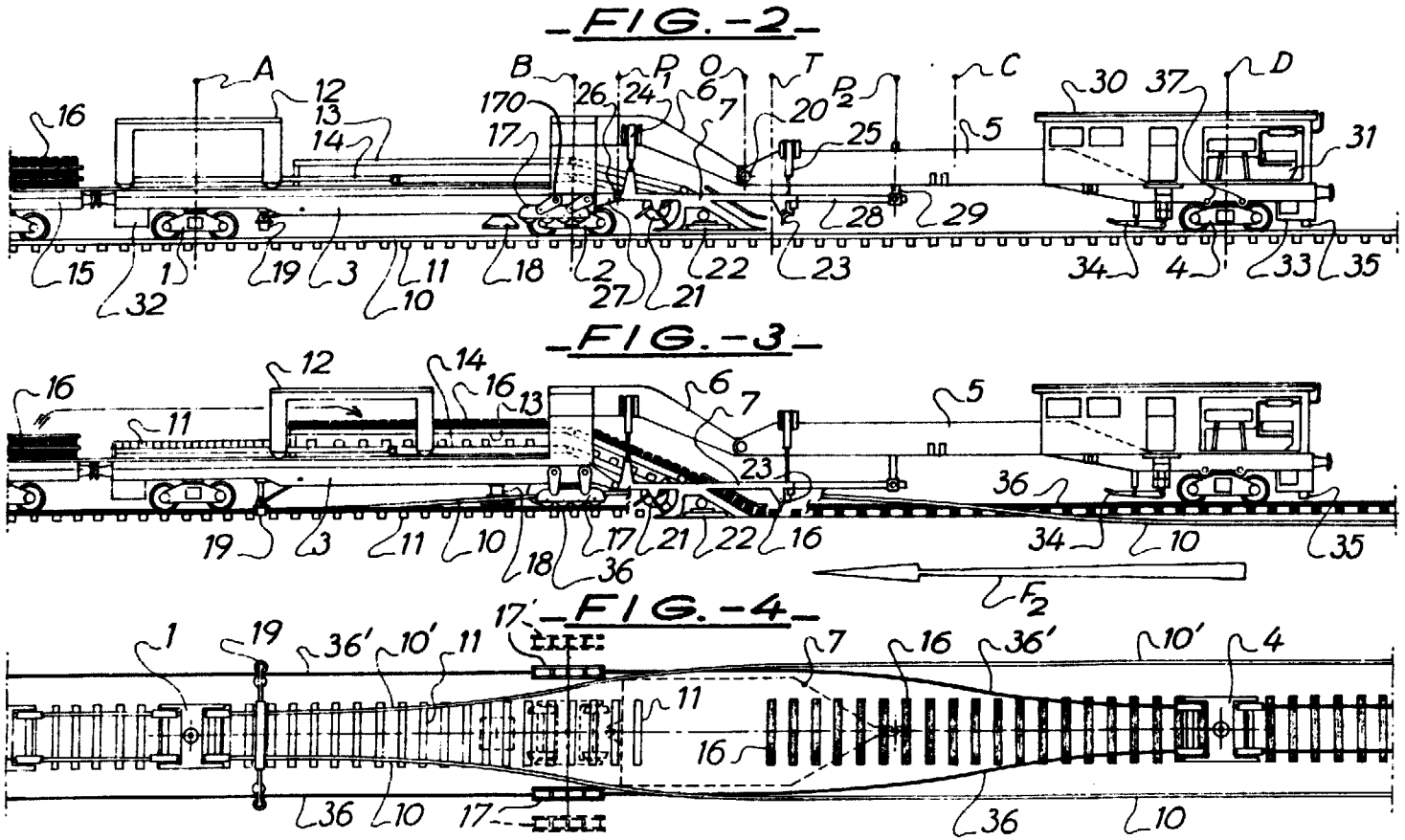
FIG. 2 is a side view of the apparatus of FIG. 1 in a light running mode.
FIG. 3 is a side view of the apparatus in a railway track renewal mode.
FIG. 4 is a partial schematic plan view of the arrangement of FIG. 3.

In FIG. 2, vertical axes are designated as passing through the various points shown in FIG. 1. The wagon 3 is shown rolling on the old track comprising rails 10 and ties 11 and the arrangement of the overhanging bracket 6 of the wagon 3, the single bogie 4, wagon 5 and the work tool carrying chassis 7 can be clearly seen.

Figure 4A:
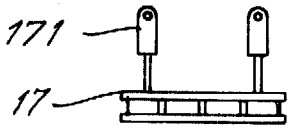
FIG. 4*a* is a diagrammatic detail.

The wagon 3 is equipped with a conveying gantry 12, with an accumulator conveyor 13 for new ties and with an accumulator conveyor 14 for old ties. This wagon 3 is coupled to a train of wagons for the stocking of new and old ties the first wagon 15 which is partially represented having its stock of new ties 16. This wagon 3 is also equipped with two supplementary rolling supports 17, 17' disposed on each side of the bogie 2 situated adjacent the overhanging bracket 6. The supports 17,17' are swingingly extendible and retractable vertically relative to the track about their pivots 170 under the action of gravity or any suitable means and movable transversely of the track by any suitable means, diagramatically shown as hydraulic cylinders 171 in FIG. 4*a*. The wagon 3 also has a vertically retractable bearing support or shoe 18 and a device 19, for positioning the rails which are vertically and transversally extendable and retractable. These elements 17, 18 and 19 as seen in FIG. 2 are in a retracted position for light running. The shoe 18 is adapted to raise the bogie 2 to permit the operation of the supplementary supports 17, as will be subsequently shown.

A swivel type joint 20 connects the wagon 5 to the wagon 3 at the vertical axis passing through the point O. This joint ensures the free pivoting of these two wagons in all directions as well as their axial rotation, at least within the maximum limits of the curves and bends of the railway tracks.

The chassis 7, here shown in the raised position for light running comprises, from left-to-right-hand sides of the drawing, a tie removing tool 21, a ballast bed remaking tool 22 and tie laying tool 23. The tie removing tool 21 and the tie laying tool 23 are respectively connected to the accumulator conveyor 14 and 13 of the wagon 3 by two articulated conveyors.

The chassis 7 is vertically adjustable by a group of vertically hanging jacks 24 and 25 and is pivotally connected at its end on the left-hand side of the drawing perpendicularly of the axis passing through the point $P_1$, to a vertical pivot 26 carried by a rocking lever 27 connected to the base of the bracket 6, at the junction of this with the chassis of the wagon 3. At its other, right-hand, end, constituted by a shaft 28, the chassis 7 is connected to a second pivot 29 comprising a rotatable bearing mounted at the end and across which the said shaft slides axially. Moreover, this pivot 29 is guided in a vertical slide integral with the chassis of the wagon 5 so as to permit the free adjustment of the height of the chassis 7 by the jacks 24 and 25.

The wagon 5 has a control cabin 30 and a group energy generator 31 adapted to supply all the services of the renewal apparatus.

A locomotive vehicle (not shown) is coupled at the end of a train of wagons stocking ties. Small material such at tie screws, sole plates, fish plates, etc . . . is stocked in containers 32 and 33 disposed respectively at the end of the wagon 3 and of the wagon 5, so as to counter-balance the overhanging structures of the system as much as possible.

The wagon 5 has a second height adjustable tie laying tool 34 disposed near its single bogie 4 and in front thereof towards the right-hand side of the drawing.

A second rail positioning device 35 is located behind bogie 4 and is similar to the rail positioning device 19 of the wagon 3. One might utilize in another embodiment a single one of these positioning devices which would be alternatively installable on the wagon 3 or on the wagon 5 in accordance with the work to be undertaken, as will be described later. The wagon 5 also has two supports 37 disposed on each side of its bogie 4, as has bogie 2 situated underneath the overhanging bracket of the wagon 3. The two supports 37 are appropriately equipped with two supplementary vertically extendable and retractable and detachable support members 17,17' which are here shown mounted on the wagon 3 but could just as easily be shown in position on the wagon 5 on the two supports 37 and operable in similar manner as on the wagon 3.

In the track renewal mode represented in FIGS. 3 and 4 the new rails 36, 36' are represented in strong solid lines and are to replace the old rails 10,10'. These new rails have previously been disposed along either side of the old track and on the outside of the old ties 11 which are lightly represented in non-solid manner in the drawings as opposed to the new ties 16 which are represented in dark lines.

When commencing the renewal operation, the shoe 18 is lowered in such a manner as to raise the bogie 2 of the wagon 3 for example with the aid of a hydraulic jack operating between the shoe 18 and the chassis of the said wagon 3, for facilitating the operation of the two supplementary rolling support members 17,17' on the new rails 36,36'. The rail positioner 19 is likewise operated. Then after cutting the old track and operating the work tools of the carrying chassis 7 in known manner, the apparatus described advances from right to left in accordance with the arrow $F_2$. The wagon 3 is partly supported by its bogie 1 on the old track to be renewed and partly supported by its supporting members 17, 17' on the new rails 36,36' previously adjusted with respect to their mutual spacing by the positioning device 19, and the wagon 5 rolls on the new reconstituted track.

Between these two wagons, that is to say below the carrying structure which they form, the old ties 11 are lifted by the lifting tool 21 and removed by the conveyor-accumulator 14 and the gantry 12 to the stocking wagons. The ballast bed is flattened and adjusted by the remaking tool 22 and the new ties 16 are brought by the gantry 12 and the conveyor accumulator complex 13 to the laying tool 23, so that the old rails 10,10' are removed and replaced by the new ones 36,36' by a rail positioning device having rollers (not shown) in known manner and already described in particular in the aforementioned Swiss Pat. No. 511,332.

In the construction mode represented in FIGS. 5 and 6 it will be appreciated that the apparatus moves in the opposite direction in accordance with the arrow $F_3$, i.e. from the left to the right hand side in the drawing.

In this mode, the bogie 4 of the wagon 5 moves on the supplementary support members 17,17' which are here repositioned on the appropriate supports 37 and supported on the new rails 36,36' previously laid on the bed 39 of the track under construction and arranged at the spacing of the said support members by the positioning device 35. A second tie laying tool 34 is utilized while the chassis 7 is left out of service and tool 34 is provided with tie conveyor 38 connected to the conveyor accumulator complex 13. The conveyor 38 extending up to the second tie laying tool 34.

As the new ties 16 are delivered by the gantry 12, the accumulatorconveyor complex 13 and the conveyor 38 to the laying tool 34 and then laid, the new rails 36 36' are also brought near and then laid at the normal spacing on the said new ties 16 and the two bogies 1 and 2 of the wagon 3 roll on the thus laid new track.

It will be seen that the apparatus thus constituted and operated for renewing and for construction of railway tracks provides a simplification and a lightening of the carrying bridge structure permitting for the renewal of an old track and an automatic positioning effect of the longitudinal axis of the carrying chassis 7 tangentially to the longitudinal axis of the track. The present apparatus produces the same effect as known apparatus and additionally can effect the construction of a new track. Also, the known bridge structure comprising a girder jointed between the two overhanging brackets of two, two bogie wagons framing the said girder is replaced by two wagons one of which has but one bogie and there is but one overhanging bracket instead of two.

This apparatus presents the advantage of permitting rapid transformation into a construction mode with a minimum of supplementary equipment.

Moreover, the preferred addition in the renewal mode of the two supplementary support members 17, 17' adapted to roll on the new rails 36,36' previously laid outside the old track permits the commencement of the removal of the old rails 10,10' underneath the wagon 3, and such permits the shortening of the span of the carrying bridge structure.

Different variations are possible for example, the supplementary rolling supports 17,17' in either the renewal or construction modes could be adapted to roll directly on the ballast, outside the track, (see exaggerated position in FIGS. 4 and 6) and could be constituted to this effect for example, by tracks or low pressure tired wheels. These supplementary rolling supports 17,17' could also be made non-removable and integral with the two wagons 3 and 5 at their pre-determined positions. They could also, additionally, be made transversably extendable and retractable.

The pivot 29 of the chassis 7 could be pivoted at its end opposite to the rotatable bearing to a horizontal axle transverse to the track and the shaft 28 of the chassis 7 could comprise a horizontal fork articulated to a horizontal transverse axle integral with the said rotatable bearing.

What we claim is:

1. A mobile apparatus for laying of railway tracks comprising a working tool carrying chassis adapted to effect at least the laying of new ties, a wagon for transporting and for the handling of material necessary for the said laying, and a carrying bridge structure having one end carried by a rolling support and the other end comprising a rolling support and at least one supplementary retractable rolling support adapted to bear on the track bed adapted to support a new track to be constructed, said carrying chassis being suspended above a working zone from the said carrying bridge structure, characterized in that the carrying bridge structure comprises a wagon having only a single rolling support disposed at its end and provided with said retractable supplementary rolling support and a longitudinally extending raised chassis which is pivoted at its other end to an overhanging bracket extending from the wagon adapted for transport, and the handling of material; and in that the carrying chassis is suspended and articulated at one end to the overhanging bracket and at the other end to the raised chassis of the wagon having a single rolling support; and in that this carrying chassis is mounted so as to be height adjustable; and in that the single rolling support wagon has a supplementary height adjustable tie laying means on its raised chassis and disposed near its rolling support.

2. Apparatus as claimed in claim 1, in which the two wagons have an articulated connection to each other such as to produce a swivel effect between them ensuring the free longitudinal articulation of the wagons in all directions as well as their axial rotation, at least within the maximum limits of the curves and bends of the railway tracks.

3. Apparatus as claimed in claim 1 in which the retractable supplementary rolling support comprises two members one disposed on each side of the single rolling support of the wagon having the raised chassis which are extendible and retractable vertically and transversely to the track and means to extend and retract said two members vertically and transversely to the track.

4. Apparatus as claimed in claim 3 in which the two extendable and retractable members of the supplementary rolling support are detachable.

5. Apparatus as claimed in claim 3 in which two members of the supplementary rolling support are adapted to run on the ballast outside the ties of the track and on each side thereof.

6. Apparatus as claimed in claim 3 in which the two members of the supplementary rolling support are adapted to run on rails disposed on the ballast outside the ties of the track and on each side thereof.

7. Apparatus as claimed in claim 6 including a rail positioning device adapted to position the rails disposed on the ballast at a spacing corresponding to that of the two supplementary rolling support members in the extended position and in which this positioning device is disposed in front of the said two members in the direction of advance of the work.

8. Apparatus as claimed in claim 1 in which said carrying chassis is articulated by its two ends to two vertical pivots one integral with the overhanging bracket and the other with the raised chassis of the one rolling support wagon and in which one of the two ends of the carrying chassis is constituted by a shaft slidable axially in a rotatable bearing mounted at the end of a pivot to which it is articulated.

9. Apparatus as claimed in claim 8 in which at least one of the two vertical pivots is mounted so as to be adjustable in height.

10. Apparatus as claimed in claim 1 wherein said working tool carrier is further adapted to effect the removal of old ties and wherein the handling of material for said laying includes the stocking of said material and the stocking and handling of material resulting from said removal.

11. Apparatus as claimed in claim 10 in which the chassis of the wagon adapted for transport and for the handing of material has on each side of its rolling support adjacent the overhanging bracket, two supplementary supports and means to extend and retract them.

12. Apparatus as claimed in claim 11, in which the chassis of the wagon adapted for transport and for the handling of material includes a rail positioning device disposed in front of the rolling support situated on the side of the overhanging bracket which extends it and in the direction of its other rolling support; such rail positioning device being adapted to locate the rails disposed on the ballast at a spacing corresponding to that of the two retractable and removable support members in the extended position.

13. Apparatus as claimed in claim 11 including a shoe for lifting up the rolling support adjacent the overhanging bracket.

* * * * *